US006708342B2

(12) United States Patent
Boersema

(10) Patent No.: US 6,708,342 B2
(45) **Date of Patent: *Mar. 23, 2004**

(54) INFANT CLOTHING WITH TRACTION DEVICES

(76) Inventor: Tasha Boersema, 683 Sleepy Hollow La., Holland, MI (US) 49423

( * ) Notice: Subject to any disclaimer, the term of this patent is extended or adjusted under 35 U.S.C. 154(b) by 0 days.

This patent is subject to a terminal disclaimer.

(21) Appl. No.: 10/097,220

(22) Filed: Mar. 13, 2002

(65) Prior Publication Data

US 2003/0000003 A1 Jan. 2, 2003

Related U.S. Application Data

(63) Continuation-in-part of application No. 09/894,736, filed on Jun. 28, 2001, now Pat. No. 6,385,779.

(51) Int. Cl.[7] ..... A41B 1/00
(52) U.S. Cl. ..... 2/69; 2/80
(58) Field of Search ..... 2/239, 409, 69, 2/69.5, 79, 80, 83, 227, 78.1–78.3, 114, 115, 46, 22, 23, 455, 456, 16, 59, 243.1; 36/110–113, 136, 7.1 R, 72, 9 R, 9 A, 10, 70 R, 4

(56) References Cited

U.S. PATENT DOCUMENTS 266,614 A * 10/1882 Douglass ..... 2/239
2,725,567 A * 12/1955 Bevier ..... 2/83
4,069,515 A 1/1978 Swallow et al.
4,149,274 A 4/1979 Garrou et al.
4,294,022 A 10/1981 Stockli et al.
4,651,354 A 3/1987 Petrey
4,843,648 A * 7/1989 Goldberg ..... 2/80
4,845,778 A * 7/1989 Peterson ..... 2/24
D322,881 S 1/1992 Bushman
5,153,940 A 10/1992 Bergquist
5,204,996 A 4/1993 Ehmka
D347,518 S 6/1994 Stewart
D375,616 S 11/1996 Baker et al.
5,617,585 A 4/1997 Fons et al.
5,708,985 A 1/1998 Ogden
5,729,836 A * 3/1998 Ewing ..... 2/69 X
5,737,776 A 4/1998 Jennings
5,845,335 A * 12/1998 Twitty ..... 2/80
5,926,888 A 7/1999 Chen et al.
5,933,864 A * 8/1999 Boykins ..... 2/69
6,332,224 B1 * 12/2001 Walker et al. ..... 2/239
6,339,847 B1 1/2002 Hanks
6,385,779 B2 * 5/2002 Boersema ..... 2/239

* cited by examiner

*Primary Examiner*—Gloria M. Hale
(74) *Attorney, Agent, or Firm*—MacMillan, Sobanski & Todd, LLC

(57) ABSTRACT

An article of clothing for an infant includes a body, such as a band, a sock, a pair of pants, a shirt or a jumper, formed of one material and an attached gripper member formed of another material having a greater coefficient of friction than that of the first material. The gripper member is positioned on an upper, bottom and/or side surface of a foot portion, a knee area or an elbow area to assist a crawling or recently walking infant. A pad can be superposed with the gripper member in the knee area or the elbow area.

16 Claims, 6 Drawing Sheets

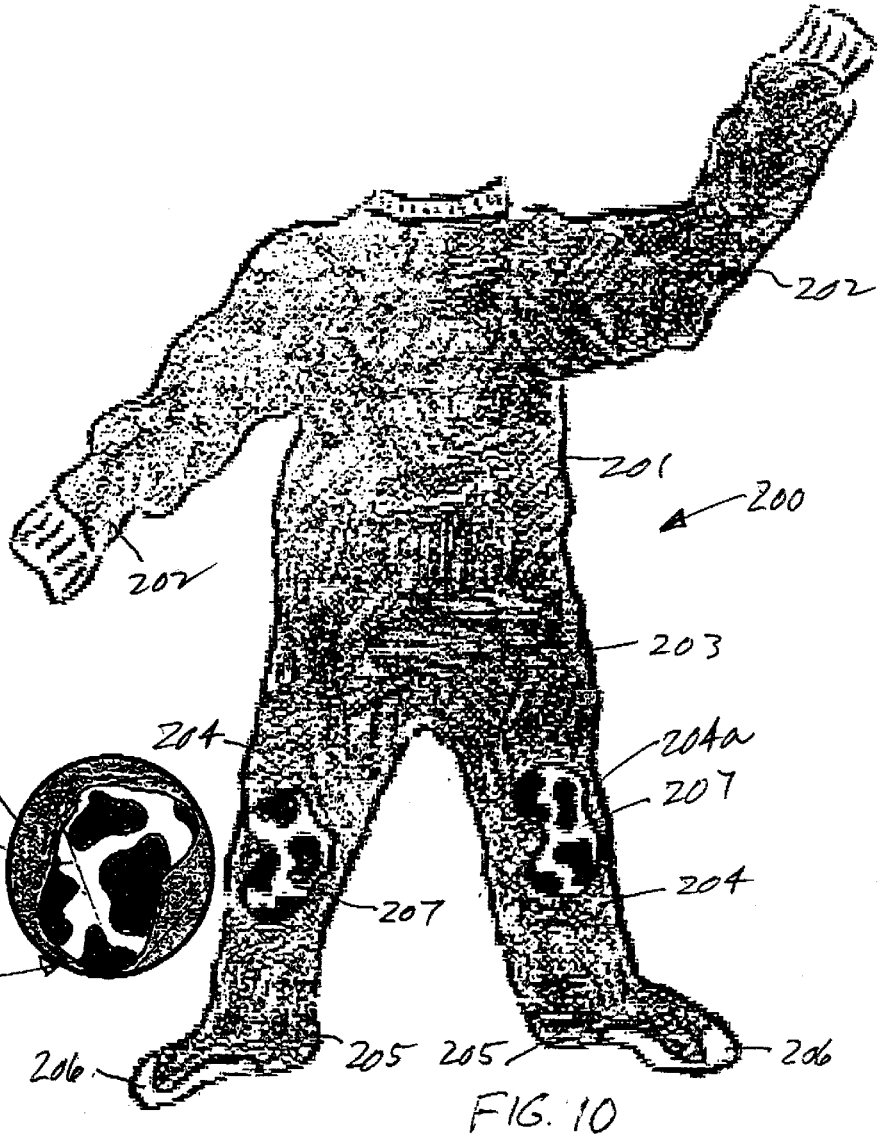
FIG. 11
FIG. 10
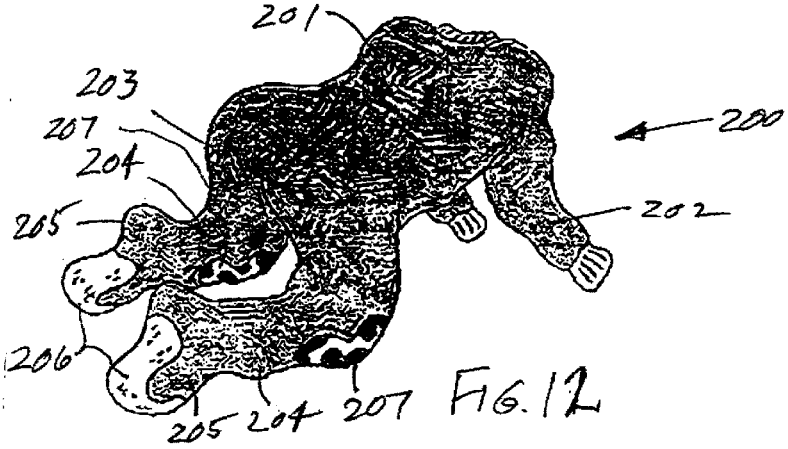
FIG. 12

INFANT CLOTHING WITH TRACTION DEVICES

CROSS-REFERENCE TO RELATED APPLICATION

This application is a continuation-in-part of the U.S. patent application Ser. No. 09/894,736, filed Jun. 28, 2001 now U.S. Pat. No. 6,835,779.

BACKGROUND OF THE INVENTION

The present invention relates generally to articles of clothing for an infant and, in particular, to clothing designed to provide additional traction for a crawling and/or walking infant.

Socks are one type of infant clothing. Dressing an infant with fabric socks is advantageous in many ways. Socks are aesthetically pleasing, keep the infant's feet warm and protect the infant's feet from minor cuts and abrasions. When the infant becomes ambulatory, however, socks can be disadvantageous on smooth floor surfaces, such as hardwood or linoleum floors, because there is a very low coefficient of friction between fabric material of the socks and the floor surface. This poses an increased risk of injury because the infant may slip and fall on the smooth surface while wearing only the fabric socks. Dressing the infant with shoes is one solution to this problem, but it is not always desirable, and is often difficult, to put shoes on an ambulatory infant.

This is a recognized problem, and many prior art infants socks, therefore, have been fitted with material that provides greater traction on the bottom of the sock. This material is also referred to as a gripper area. These prior art socks have worked well for those infants who have already progressed to walking, because the portion of the sock with the gripper area is in contact with the smooth floor surface. These prior art socks, however, have been disadvantageous for crawling infants, because typically the feet of crawling infants contact the floor surface with portion of the foot closest to the toes or the top of the foot, rather than the bottom of the foot. Because the top portion of the prior art socks did not contain a gripper area on the toes or top of the sock, the same problems were encountered as with socks without any gripper area, which results in an increased risk of injury to crawling infants wearing the prior art socks.

It is desirable to provide an article of infant clothing that will provide greater traction for crawling infants as well as for infants that are already walking.

It also is desirable to provide infant apparel that will protect the knees and elbows of crawling infants as well infants that are already walking.

SUMMARY OF THE INVENTION

The present invention concerns infant apparel for use with a crawling and/or walking infant. For example, one article of infant apparel is a sock member with an upper surface, a lower surface, and a toe portion connecting and enclosing the upper and lower surfaces at a leading edge of the sock member. A traction device in the form of a gripper area is attached to the exterior portion of the sock member and preferably extends from the upper surface to the toe area and further to the lower surface. The gripper area is preferably a frictional material that has a greater coefficient of friction than the material forming the sock member. The sock member can be tubular or foot-shaped for ease of dressing the infant. Alternatively, the gripper area is formed in a tread pattern and can include transversely or circumferentially spaced ribs along the upper surface, toe portion, and lower surface. In either sock shape, the gripper area can extend to a side area of the sock to aid a crawling infant.

The present invention recognizes that prior art socks were suitable neither for providing traction to crawling infants nor for reducing the risk of injury to crawling infants on smooth floor surfaces. With a gripper area at the top surface and toe portion of the sock member, the sock provides infants a greater ability to crawl on smooth surfaces, while reducing the risk of injury to the crawling infants. The present invention is also suitable for infants who have progressed to walking, because the gripper area extends to the lower surface of the sock member.

In addition to socks, articles of clothing such as jumpers and pants can have the traction devices on both the feet and knee portions. Furthermore, pads can be provided in the knee portions to protect the infant's knees during crawling or in case of a fall during walking. The pads can be positioned on either the exterior or the interior of the material forming the article of clothing. The feet portions also can be detachable.

The present invention is a novel improvement over the prior art because while the prior art teaches many different varieties of infant socks, none of the prior art teaches an infant sock or foot portion with a gripper area extending to the toe, the side area and the upper surface of the sock member for the purpose of providing traction to crawling infants.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 10 is a front perspective view of an infant jumper in accordance with another embodiment of the present invention;

FIG. 11 is an enlarged view of a knee portion of the infant jumper shown in FIG. 10; and FIG. 12 is a rear perspective view of the infant jumper shown in FIG. 10.

DESCRIPTION OF THE PREFERRED EMBODIMENT

Figure 1:
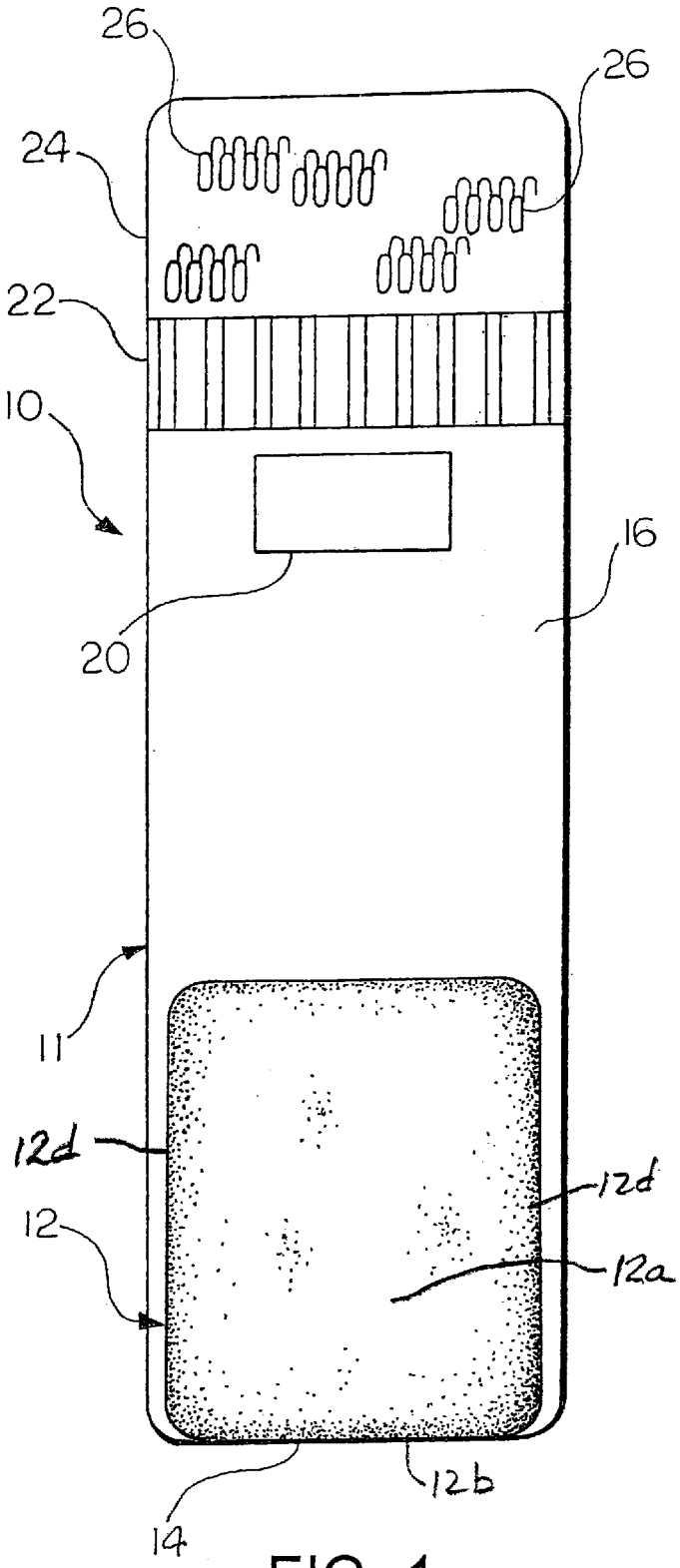
FIG. 1 is a bottom view of an infant sock in accordance with the present invention.
Figure 2:
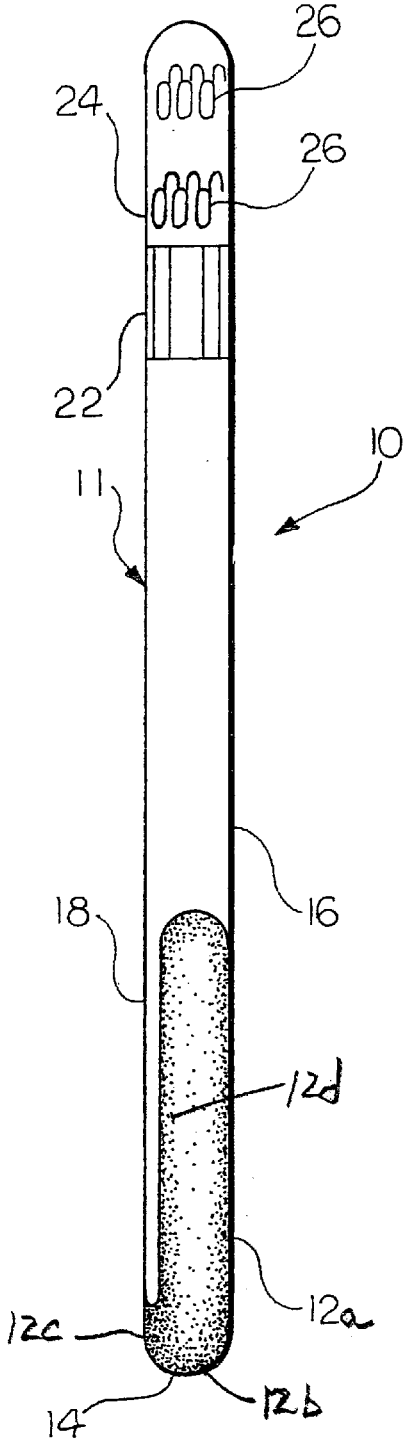
FIG. 2 is a side view of the infant sock in FIG. 1.

Referring now to FIGS. 1 and 2, an article of infant apparel or clothing such as an infant sock is shown generally at 10. The infant sock 10 includes a generally tubular sock member 11 having an exterior upper surface 18, an exterior lower surface 16, and an exterior toe surface 14 on the exterior thereof. The toe surface 14 defines an enclosed end of the sock member 11 opposite an open end for receiving an infant's foot (not shown). The sock member 11 is preferably constructed of a natural fabric material, such as cotton, or a synthetic fabric material, such as nylon or spandex, or a combination of such materials. Preferably the infant sock 10 is latex free. The upper surface 18 and the lower surface 16 preferably consist of the same amount of fabric material so as to ensure a good fit on an infant's foot (not shown.) The infant sock 10 is preferably sized to fit an infant learning to crawl. A typical age for such an infant is about four months of age to about one year of age.

A traction device in the form of a gripper member 12 is adhered to the exterior lower surface 16, the exterior upper surface 18, and the exterior toe surface 14. Preferably the gripper member 12 covers a continuous area of the sock member 11 including a lower portion 12*a* extending partially along the exterior lower surface 16, a toe portion 12*b* extending along the exterior toe surface 14 and a top portion 12*c* extending partially along the exterior upper surface 18 of the sock member 11. The area covered by the gripper portion 12*a* on the exterior lower surface 16 is preferably greater than the area covered by the gripper portion 12*c* on the exterior upper surface 18. The gripper member 12 preferably covers most, if not all, of the area of the exterior toe surface 14. Alternatively, the gripper member 12 covers a greater area on the exterior upper surface 18 than on the exterior lower surface 16. Also, the gripper member 12 can extend along a side area where the surfaces 16 and 18 meet forming a side portion 12*d*. The gripper member 12 is preferably constructed of a material that increases the coefficient of friction with a floor surface, such as a rubberized material or the like, having a coefficient of friction greater than a coefficient of friction of the material from which the sock member 11 is made. The material of the gripper member 12 is flexible and withstands laundering. The material of the gripper member 12 may be adhered to the sock member 11 by a thermal process, such as an applique process.

When crawling, an infant's feet are positioned upside down such that the toe portion 12*b* and the upper portion 12*c* come into contact with the floor surface providing traction. Often, the infant will turn his/her toes in or out causing the side portion 12*d* to contact the floor surface providing traction. When walking, the lower portion 12*a* contacts the floor surface providing traction. Thus, whether crawling or walking, the traction device 12 aids the mobility of the infant.

The sock member 11 also includes an annular elastic band 22 attached to the upper surface 18 and lower surface 16 that forms the open end for receiving the infant's foot. The elastic band 22 also aids in keeping the sock member 11 in place on the infant's lower leg (not shown.) The elastic band 22 preferably includes a fabric sheath for comfort. A tubular entrance band 24 is attached to the elastic band 22. The entrance band 24 is preferably constructed of the same material as the sock member 11 and may include a typical knitting pattern 26. The knitting pattern 26 preferably consists of multiple parallel ribs of knitted fabric that may be folded towards the toe surface 14 as desired for aesthetic purposes. The sock member 11 also includes an emblem or similar indicia 20 on the lower surface 16. The emblem 20 may be constructed of the same material as the gripper member 12. Alternatively, the emblem 20 is attached to the upper surface 18 or to the entrance band 24.

Figure 3:
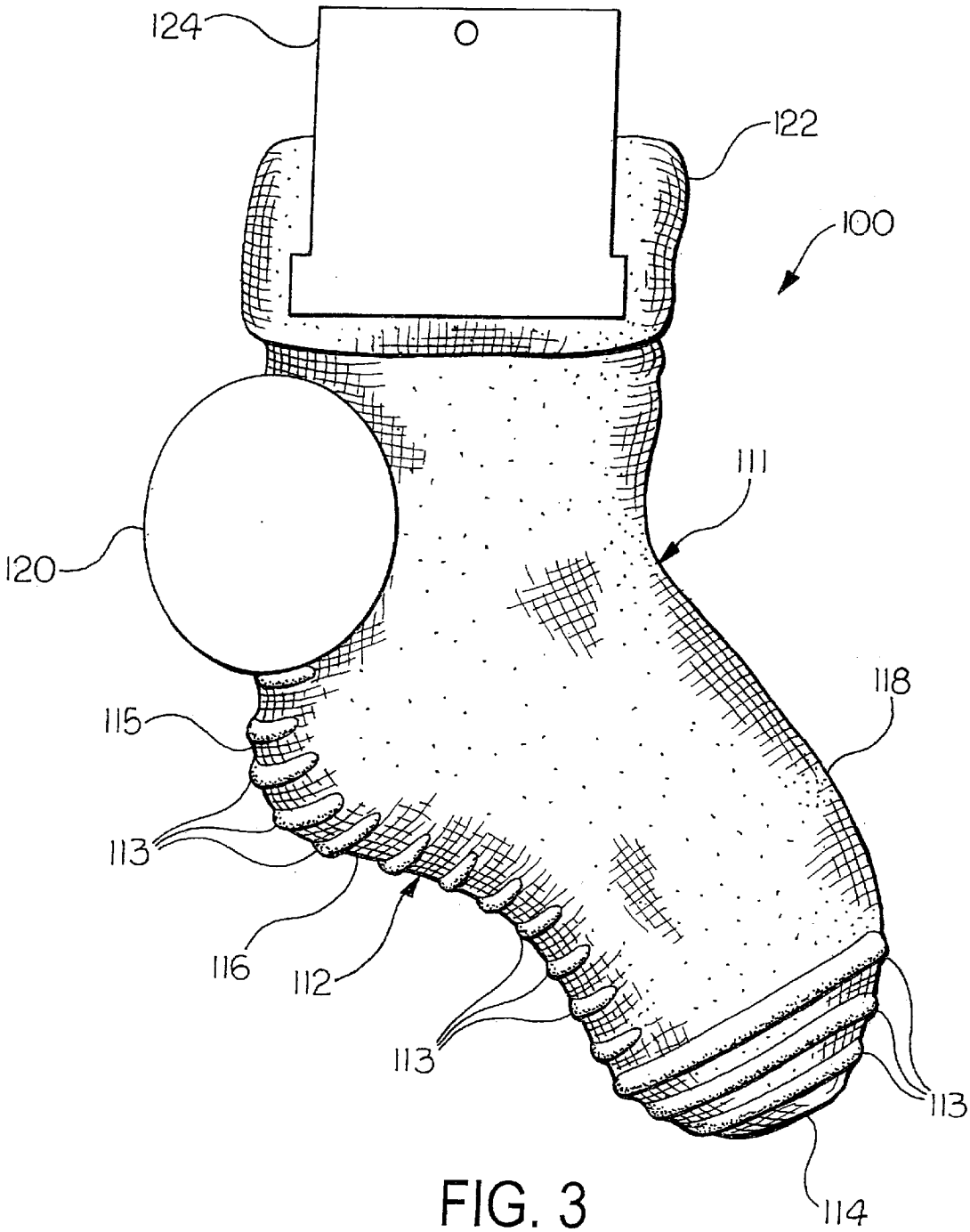
FIG. 3 is a perspective view of an alternative embodiment of an infant sock in accordance with the present invention.

Referring now to FIG. 3, an alternative embodiment of an infant sock is shown generally at 100. The infant sock 100 includes a generally foot-shaped sock member 111. The sock member 111 includes an upper surface 118, a lower surface 116, and a toe surface 114. The toe surface 114 forms an enclosed end of the upper surface 118, and the lower surface 116. The sock member 111 can be constructed of any suitable material, or a combination of such materials, as described above. Preferably the infant sock 100 is latex free. The infant sock 100 is preferably sized to fit an infant learning to crawl and/or walk. A typical age for such an infant is about four months of age to about one year of age.

A gripper member 112 is adhered to the lower surface 116, the upper surface 118, and the toe surface 114. The gripper member 112 can be formed as a tread pattern composed of a series of spaced ribs 113 extending transverse to a length of the sock member 111. The ribs 113 may be spaced along the lower surface 116, and may extend to the upper surface 118, and the toe surface 114. Preferably the gripper member 112 covers an area of the sock member 111 extending from a seam on the upper surface 118 (not shown) at the toe surface 114 to a front-to-mid section of the lower surface 116 of the sock member 111. The area covered by the gripper member 112 on the lower surface 116 is preferably greater than the area covered by the gripper member 112 on the upper surface 118, and the gripper member 112 may extend back to a heel portion 115 of the sock member 111. The gripper member 112 preferably covers most of the fabric material of the toe surface 114. The transverse ribs 113 on the toe surface 114 may extend completely around the circumference of the toe surface 114 and/or onto a side surface where the lower surface 116 joins the upper surface 118. The gripper member 112 is preferably constructed of a material that has a greater coefficient of friction than the sock material, such as a rubberized material or the like. The material of the gripper member 112 is flexible and withstands laundering. The material of the gripper member 112 may be adhered to the sock member 111 by a thermal process, such as an appliqué process.

The sock member 111 also includes a tubular elastic band 122 at an open upper end for receiving the infant's foot which also aids in keeping the sock member 111 in place on the infant's lower leg (not shown). The elastic band 122 preferably contains a fabric sheath for comfort. An emblem or similar indicia 120 can be affixed to the sock member 111. The emblem 120 may be constructed of the same material as the gripper member 112. A packaging tab 124 can be attached to the sock member 111 as desired.

Figure 4:
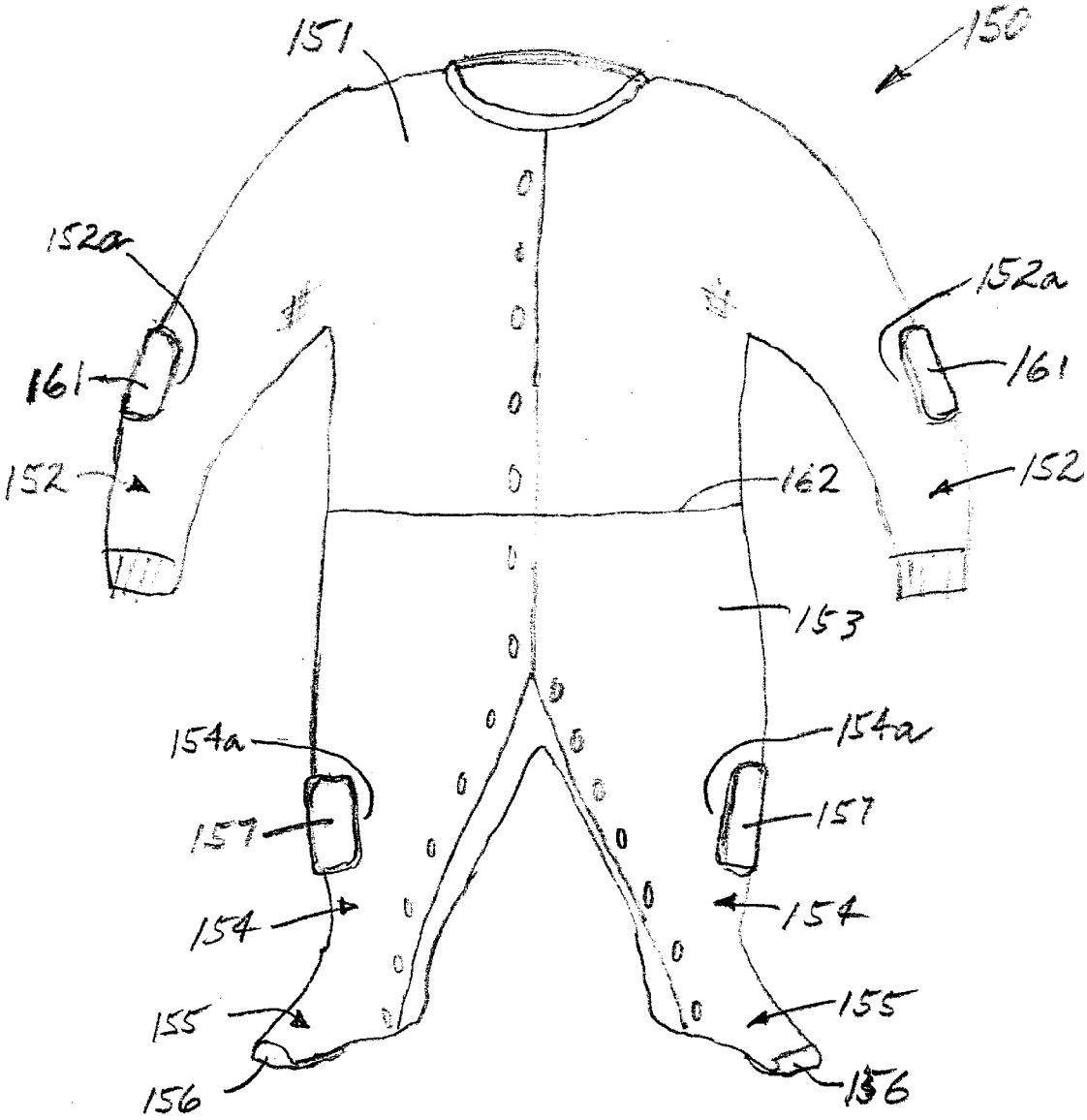
FIG. 4 is a front elevation view of an infant jumper in accordance with the present invention.

Referring to FIG. 4, there is shown an article of infant clothing or apparel such as an infant jumper 150 made from a suitable cloth material and having an upper body portion 151 from which extend arm portions 152 and a lower body portion 153 from which extend leg portions 154. At the lower end of each of the leg portions 154 is a foot portion 155. The foot portions 155 each can have a first traction device 156 or gripper member similar to the gripper members 12 and 112 attached thereto. In addition, each of the leg portions 154 can have a second traction device 157 or gripper member attached thereto, preferably in a knee area 154*a* corresponding to location of a knee of an infant wearing the jumper 150. The gripper members 156 and 157 are preferably constructed of a material that increases the coefficient of friction between the material of the jumper 150 and a floor surface.

Figure 5:
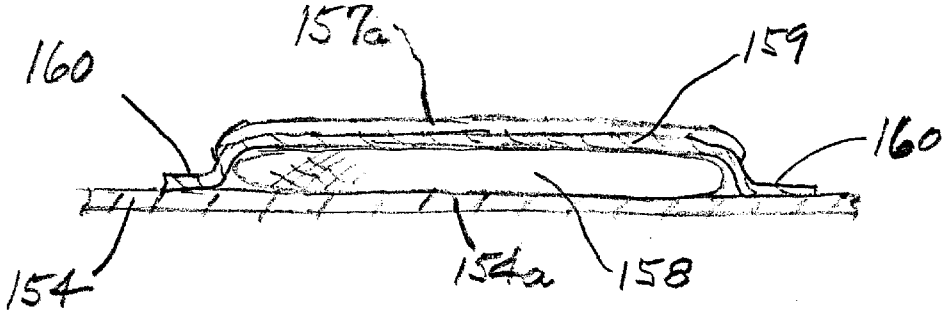
FIG. 5 is a cross-sectional view of an alternate embodiment of the knee area of the jumper shown in FIG. 4.
Figure 6:
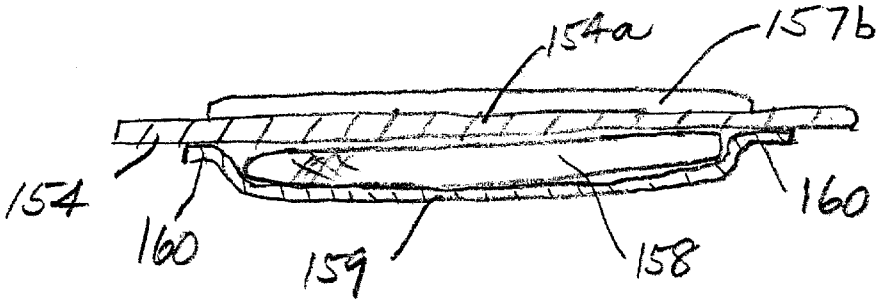
FIG. 6 is a cross-sectional view of another alternate embodiment of the knee area shown in FIG. 4.

The traction devices 157 can be used with padding as shown in FIGS. 5 and 6. In an alternate embodiment of FIG. 5, there is shown the knee area 154*a* of the leg 154 in cross section. A pad 158 of cushioning material is positioned on an exterior surface of the knee area 154*a*. The pad 158 is enclosed by a cover 159 that can be attached to the leg portion 154 in any suitable manner such as by a fastener means 160 in the form of stitches or adhesive. A second traction device 157*a* is attached to the outer surface of the cover 159 superposed with the pad 158. In another alternate embodiment of FIG. 6, the pad 158 of cushioning material is positioned on an interior surface of the knee area 154*a*. The pad 158 is enclosed by the cover 159 that can be attached to the leg portion 154 in any suitable manner such as by the fastener means 160 in the form of stitches or adhesive. A second traction device 157*b* is attached to the exterior surface of the leg portion 154 superposed with the pad 158. The pad 158 can be made of any suitable cushioning material including a gel filled sack.

The traction devices according to the present invention can also be used in an elbow area of an article of infant apparel. As shown in FIG. 4, a third traction device 161 can be attached to an elbow area 152*a* of each of the arm portions 152 of the jumper 152. The traction devices 161 can be used with or without the pads 158 shown in FIGS. 5 and 6. Also, although the article of apparel 150 shown in FIG. 4 has been described as a jumper, it could be a two pieces of clothing divided at an edge 162 with the upper portion 151 being a shirt and the lower portion 153 being a pair of pants.

Figure 7:
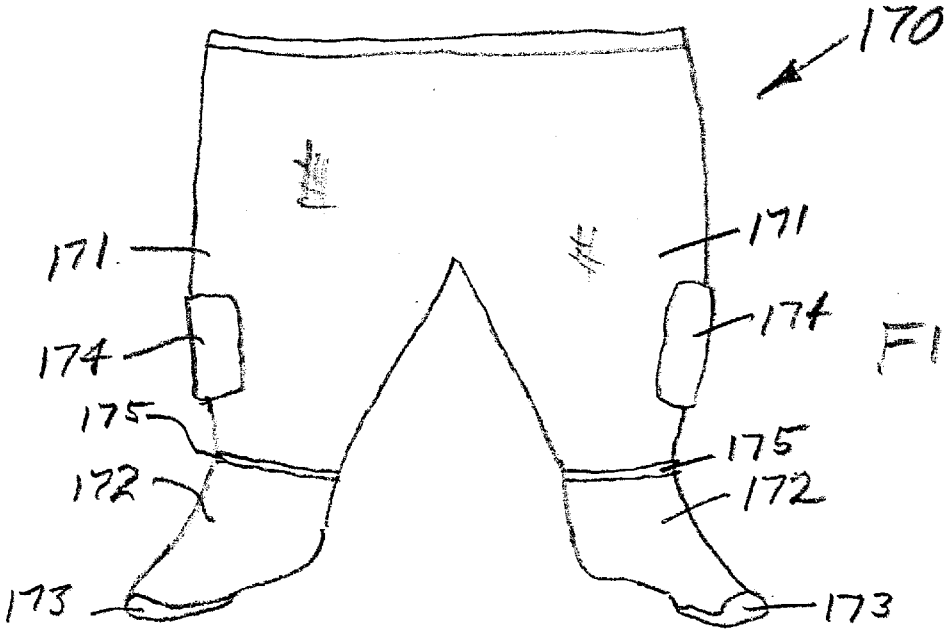
FIG. 7 is a front elevation view of a pair of infant pants in accordance with the present invention.

Referring to FIG. 7, there is shown an article of infant clothing or apparel such as a pair of infant pants or tights 170 made from a suitable cloth material and having leg portions 171. At the lower end of each of the leg portions 171 is a foot portion 172. The foot portions 172 each can have a first traction device 173 or gripper member similar to the gripper members 156 attached thereto. In addition, each of the leg portions 171 can have a second traction device 174 or gripper member attached thereto, similar to the gripper member 157, preferably in a knee area corresponding to location of a knee of an infant wearing the pants 170. The gripper members 173 and 174 are preferably constructed of a material that increases the coefficient of friction between the material of the pants 170 and a floor surface. The pants 170 also can include the pads 158 positioned beneath the gripper members 174. The foot portions 172 can be formed integral with the leg portions 171, or can be separate socks, such as the sock member 111 of FIG. 3, releasably attached to lower ends of the leg portions 171 by suitable fasteners 175 such as snaps, zippers, hook and loop, etc.

Figure 8:
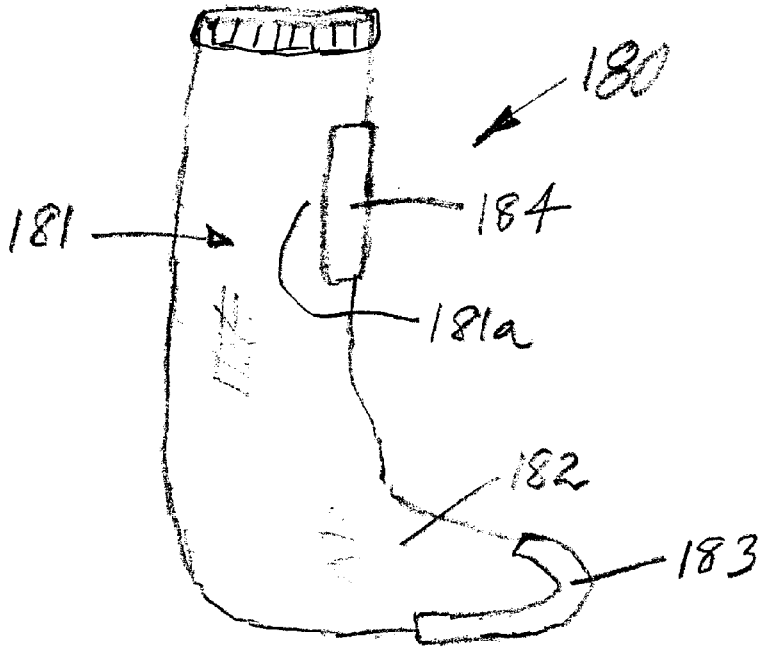
FIG. 8 is a perspective view of an over the knee infant sock according to the present invention.

There is shown in FIG. 8 an article of infant clothing or apparel 180 in the form of an over the knee sock having a leg portion 181 with an open upper end and a knee area 181*a*. Attached to a lower end of the leg portion 181 is a foot portion 182. The foot portion 182 can have a first traction device 183 or gripper member similar to the gripper members 156 and 173 attached thereto. In addition, the leg portion 181 can have a second traction device 184 or gripper member attached thereto, similar to the gripper members 157 and 174, preferably in the knee area 181*a* corresponding to location of a knee of an infant wearing the sock 180. The gripper member 184 can be used with one of the pads 158 such as in either of the constructions shown in FIGS. 5 and 6.

Figure 9:
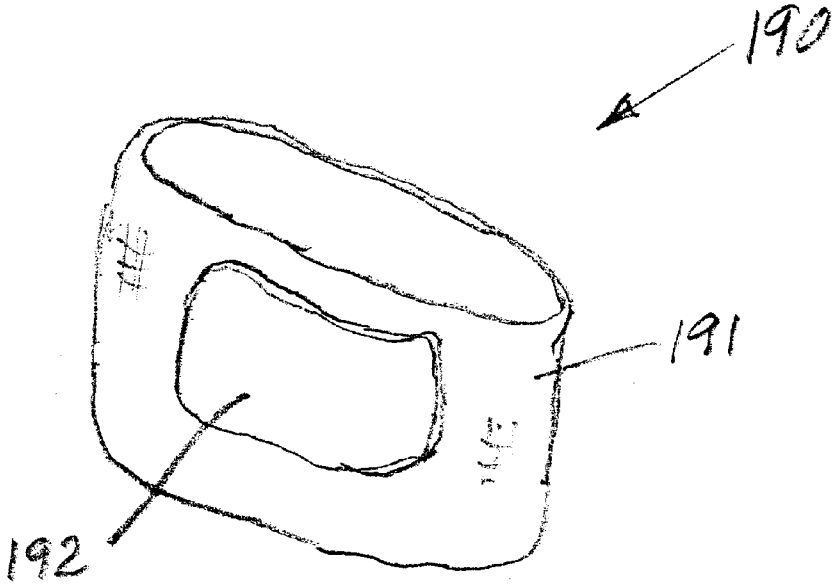
FIG. 9 is a perspective view of a knee or elbow band according to the present invention.

There is shown in FIG. 9 an article of infant clothing or apparel 190 in the form of a band to be worn over the knee or elbow of an infant. The band 190 has a generally tubular body 191 with open ends. Attached to an exterior surface of the body 191 is a traction device 192 or gripper member similar to the gripper members 157, 161, 174 and 184. The gripper member 192 can be used with one of the pads 158 such as in either of the constructions shown in FIGS. 5 and 6.

Referring to FIGS. 10 and 12, there is shown an article of infant clothing or apparel such as an infant jumper 200 made from a suitable cloth material and having an upper body portion 201 from which extend arm portions 202 and a lower body portion 203 from which extend leg portions 204. At the lower end of each of the leg portions 204 is a foot portion 205. The foot portions 205 each can have a first traction device 206 or gripper member similar to the gripper members 12, 112, 156, 173 and 183 attached thereto. In addition, each of the leg portions 204 can have a second traction device 207 or gripper member attached thereto, preferably in a knee area 204*a* corresponding to location of a knee of an infant wearing the jumper 200. The gripper members 206 and 207 are preferably constructed of a material that increases the coefficient of friction between the material of the jumper 200 and a floor surface.

As shown in more detail in FIG. 11, the traction device 207 has an irregular shape and can be provided with a design 208 on an exterior surface. While the design 208 simulates the coat of a Holstein cow, any suitable design can be used including, but not limited to, simulations of patterns occurring in nature, reproductions of art work, solid colors, existing fabric patterns and abstract designs.

The above-described articles of infant clothing or apparel can be manufactured from many different materials in a variety of colors and patterns. A natural fabric material, such as cotton, or a synthetic fabric material, such as polyester, or a combination of such materials is suitable for the bodies of the articles. The traction devices can be made from any suitable material having a higher coefficient of friction than the material from which the body of the article is made. The color of the gripper members can be the same as, complementary to or contrasting to the color of the article of infant clothing.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An article of infant clothing comprising:

a quantity of fabric material adapted to be worn on an infant body and having a lower body portion with a pair of leg portions extending therefrom, each of said leg portions terminating in a foot portion, each said foot portion having an exterior upper surface, an exterior lower surface and an exterior toe surface extending between said exterior upper surface and said exterior lower surface; and an associated gripper member attached to each said foot portion, each said gripper member covering at least a portion of each of said exterior upper surface, said exterior lower surface and said exterior toe surface, each said gripper member being formed of a material having a coefficient of friction greater than a coefficient of friction of said fabric material for providing increased traction when the article of infant clothing is worn by an infant and said gripper member contacts a surface supporting the infant during crawling and walking.

2. The article of infant clothing according to claim 1 wherein said exterior upper surface and said exterior lower surface of each said foot portion meet to form exterior side surfaces and each said gripper member covers at least a portion of said side surfaces.

3. The article of infant clothing according to claim 1 wherein said foot portions are releasably attached to said leg portions.

4. The article of infant clothing according to claim 1 wherein said gripper members are formed as tread patterns.

5. The article of infant clothing according to claim 1 wherein each said leg portion has a knee area and includes a traction device attached to said knee area.

6. The article of infant clothing according to claim 5 wherein each said traction device has a design on a visible surface thereof.

7. The article of infant clothing according to claim 5 wherein said traction device has an irregular shape.

8. The article of infant clothing according to claim 5 including an associated cushioning pad attached to each said knee area superposed by said traction device.

9. The article of infant clothing according to claim 1 including an upper portion abutting said lower portion and having a pair of arm portions extending therefrom.

10. The article of infant clothing according to claim 9 wherein each said arm portion has an elbow area and includes a traction device attached to said elbow area.

11. The article of infant clothing according to claim 10 including an associated cushioning pad attached to each said elbow area superposed by said traction device.

12. An article of infant clothing comprising:

a lower body portion adapted to be worn on an infant body and having a pair of leg portions extending therefrom, each of said leg portions terminating in a foot portion, each said foot portion having an exterior upper surface, an exterior lower surface and an exterior toe surface extending between said exterior upper surface and said exterior lower surface, said exterior upper surface and said exterior lower surface of each said foot portion meeting to form exterior side surfaces; and an associated gripper member attached to each said foot portion, each said gripper member covering at least a portion of each of said exterior upper surface, said exterior lower surface, said exterior toe surface and said exterior side surfaces, each said gripper member being formed of a material having a coefficient of friction greater than a coefficient of friction of said fabric material for providing increased traction when the article of infant clothing is worn by an infant and said gripper member contacts a surface supporting the infant during crawling and walking.

13. The article of infant clothing according to claim 12 wherein said foot portions are releasably attached to said leg portions.

14. The article of infant clothing according to claim 12 wherein said gripper members are formed as tread patterns.

15. An article of infant clothing comprising:

a quantity of fabric material adapted to be worn on an infant body and having a lower body portion with a pair of leg portions extending therefrom, each of said leg portions terminating in a foot portion, each said foot portion having an exterior upper surface, an exterior lower surface and an exterior toe surface extending between said exterior upper surface and said exterior lower surface; and an associated gripper member attached to each said foot portion, each said gripper member covering at least a portion of each of said exterior upper surface, said exterior lower surface and said exterior toe surface, each said gripper member being formed as a tread pattern of a material having a coefficient of friction greater than a coefficient of friction of said fabric material for providing increased traction when the article of infant clothing is worn by an infant and said gripper member contacts a surface supporting the infant during crawling and walking.

16. The article of infant clothing according to claim 15 wherein said foot portions are releasably attached to said leg portions.

* * * * *